US007134444B2

(12) United States Patent
Mintie et al.

(10) Patent No.: US 7,134,444 B2
(45) Date of Patent: Nov. 14, 2006

(54) ENVIRONMENTAL CONTAINMENT UNIT

(75) Inventors: Kevin J. Mintie, Glendale, CA (US); Jose Guadalupe Munoz, Valinda, CA (US)

(73) Assignee: Mintie Technologies, Inc., Los Angeles, CA (US)

( * ) Notice: Subject to any disclaimer, the term of this patent is extended or adjusted under 35 U.S.C. 154(b) by 541 days.

(21) Appl. No.: 10/627,999

(22) Filed: Jul. 25, 2003

(65) Prior Publication Data

US 2004/0050008 A1 Mar. 18, 2004

Related U.S. Application Data

(60) Provisional application No. 60/398,914, filed on Jul. 26, 2002, provisional application No. 60/486,777, filed on Jul. 11, 2003.

(51) Int. Cl.
*E04H 15/34* (2006.01)
*B08B 15/00* (2006.01)

(52) U.S. Cl. ..... 135/131; 135/139; 135/145; 135/156; 135/157; 135/900; 52/63; 55/356; 55/385.2; 454/63

(58) Field of Classification Search ..... 135/143–146, 135/156–158, 131, 139, 900; 52/63; 454/195, 454/66, 189; 55/356, 385.2
See application file for complete search history.

(56) References Cited

U.S. PATENT DOCUMENTS 3,265,059 A 8/1966 Matthews
3,352,313 A 11/1967 Kroening
3,766,844 A * 10/1973 Donnelly et al. ..... 454/238
3,896,831 A 7/1975 Feldman et al.
4,000,749 A 1/1977 Busco
4,186,507 A * 2/1980 Stinnett ..... 43/1
4,624,690 A 11/1986 Byrnes
4,682,448 A 7/1987 Healey
4,706,551 A 11/1987 Schofield
4,765,352 A 8/1988 Strieter
4,774,974 A 10/1988 Teter
4,804,392 A 2/1989 Spengler (Continued)

FOREIGN PATENT DOCUMENTS

GB 2 165 276 A * 4/1986

*Primary Examiner*—Robert Canfield
(74) *Attorney, Agent, or Firm*—Christie, Parker & Hale, LLP

(57) ABSTRACT

A portable enclosure, easily erectable and collapsible, to provide environment control and prevent contaminants from being released from the enclosure. The enclosure provides a flexible envelope attached to the interior of the space defined by vertical and horizontal supports which can be erected and collapsed. When erected the enclosure functions as an anteroom and has removable panels in the sides and top. In use, the enclosure is sealed against a vertical or horizontal surface to be worked on and a panel from the side of the enclosure is opened and closed to provide access to the surface by the user. When collapsed the enclosure is a package approximately the size of an average golf club bag which is easily portable to another location. Ducting is provided to which negative pressure pumps are connected to maintain negative pressure within the enclosure and draw contaminants into the pump and then into a closed container. In one embodiment, a four-sided flange extends from the rear side of the enclosure to allow sealing of the flange around the doorway and thereby provide a mechanism for isolating the room located interiorly of the doorway.

53 Claims, 7 Drawing Sheets

U.S. PATENT DOCUMENTS

| | | | | |
|---|---|---|---|---|
| 4,809,391 | A | 3/1989 | Soldatovic | |
| 4,866,833 | A * | 9/1989 | Ward | 29/445 |
| 4,928,581 | A * | 5/1990 | Jacobson | 454/340 |
| 4,934,396 | A * | 6/1990 | Vitta | 135/139 |
| 5,062,871 | A * | 11/1991 | Lemon, III | 55/385.2 |
| RE33,810 | E | 2/1992 | Strieter | |
| 5,558,112 | A | 9/1996 | Strieter | |
| 6,041,800 | A * | 3/2000 | Carter | 135/145 |
| 6,383,242 | B1 * | 5/2002 | Rogers et al. | 55/385.2 |

* cited by examiner

ENVIRONMENTAL CONTAINMENT UNIT

CROSS-REFERENCES TO RELATED APPLICATION(S)

This application claims priority under 35 U.S.C. §119.(e) to U.S. Provisional Application Ser. No. 60/398,914 filed Jul. 26, 2002 and U.S. Provisional 60/486,777 filed Jul. 11, 2003.

SUMMARY OF THE INVENTION

The present invention relates to a portable collapsible apparatus for use in hospitals, healthcare facilities, clean rooms and other interiors for creating a controlled localized environment which is isolated from the surrounding environment. The unit is particularly useful in applications involving construction and maintenance in ceiling cavities, wall cavities and other spaces in which plumbing, wiring, ducting and the like are located.

In another embodiment, the invention relates to an apparatus for attachment to an entry to a room for sealing and isolating the room to prevent the spread of infectious organisms and other airborne particulates from the interior of the room to the surrounding areas outside the room.

BACKGROUND OF THE INVENTION

Construction and maintenance projects in a hospital provide great potential for releasing contaminants and airborne particulates that can lead to infections or other forms of contamination. All buildings, including hospitals harbor biological pathogens in the cavities of walls, floors and ceilings. Whenever these cavities are penetrated and the air in them is disturbed, the risk of aerosolizing these pathogens is high. There are always air currents in these cavities, even those that are considered dead air spaces. When an opening is made, the air currents change and pathogens are introduced into the occupied space.

Routine maintenance and repair activities such as opening a ceiling tile or a wall to check or test equipment for elevator operation, electrical wiring, pneumatic tube systems, plumbing or air conditioning can release harmful organisms into the environment.

An infectious containment and environmental monitoring program must be established to eliminate or minimize the incidence of infectious particulates, dust, and other airborne particulates associated with construction and repair projects in healthcare facilities and other clean room type environments. Every organization must assess the level of protection needed for the various construction, repair, replacement, and maintenance activities that will be undertaken in the facility. This assessment allows the facility to tailor the level of protection to its specific needs. In addition to having an application in hospital environments, the present invention is also highly useful and applicable for applications in such areas as asbestos removal and removal of other possible airborne contaminants in many other types of facilities.

Various types of enclosures have been provided in the past for isolating a work area from the surrounding environment. An example of an isolation enclosure is provided in U.S. Pat. No. 5,558.112. This patent discloses a portable isolation enclosure apparatus for removing material from the walls of a building while isolating a portion of the wall from which the material is being removed. The apparatus is positioned against a wall such that an area of the wall is isolated from the ambient environment, and is disposed with the open side of the enclosure facing the wall such that a worker inside the enclosure can access the wall.

In Reissue 33,810 an isolation enclosure is provided for removing asbestos material from ceilings and other elevated asbestos containing structures. The enclosure includes a booth and an adjustable plenum for being raised and lowered relative to the booth to reach the heights of different ceilings. A curtain is provided which extends from the bottom of the plenum below the top of the booth to maintain a closed environment. The enclosure is provided with vacuum and ventilation systems for filtering and ventilating the air which is drawn into the enclosure.

In U.S. Pat. No. 4,682,448, an enclosure is provided for working on ceiling openings. The apparatus provides an enclosure extending from the floor to the ceiling and enabling access through a ceiling opening for above ceiling construction and/or repair while providing a isolated enclosure for preventing pathogens, dust, asbestos and other debris from being allowed to escape into the surrounding environment. Another example of a prior art enclosure is shown in U.S. Pat. No. 5,062,871.

SUMMARY OF THE PRESENT INVENTION

The present invention provides a portable collapsible environmental control apparatus that includes a unitary framework having a first set of vertical supports and a collapsible horizontal support element extending between vertical supports at the base of the vertical supports. First collapsible supports extend between a pair of adjacent vertical supports along the lengthwise dimension of the enclosure. Second collapsible supports extend between a pair of adjacent vertical supports along the widthwise dimension of the enclosure.

Sliders are mounted on each vertical support and are connected to a bottom portion of each of the first and second collapsible supports.

A flexible collapsible gas impermeable containment envelope is secured to the interior of the apparatus and encloses the top sides and bottom of the enclosure wherein the vertical supports can be raised to ceiling level and held in position against the ceiling to create a controlled environment within the control apparatus.

BRIEF DESCRIPTION OF THE DRAWINGS

The features of the invention and additional details of the apparatus according to the present invention will be more fully understood by reference to the figures of the drawing wherein.

DETAILED DESCRIPTION OF THE INVENTION

Figure 1:
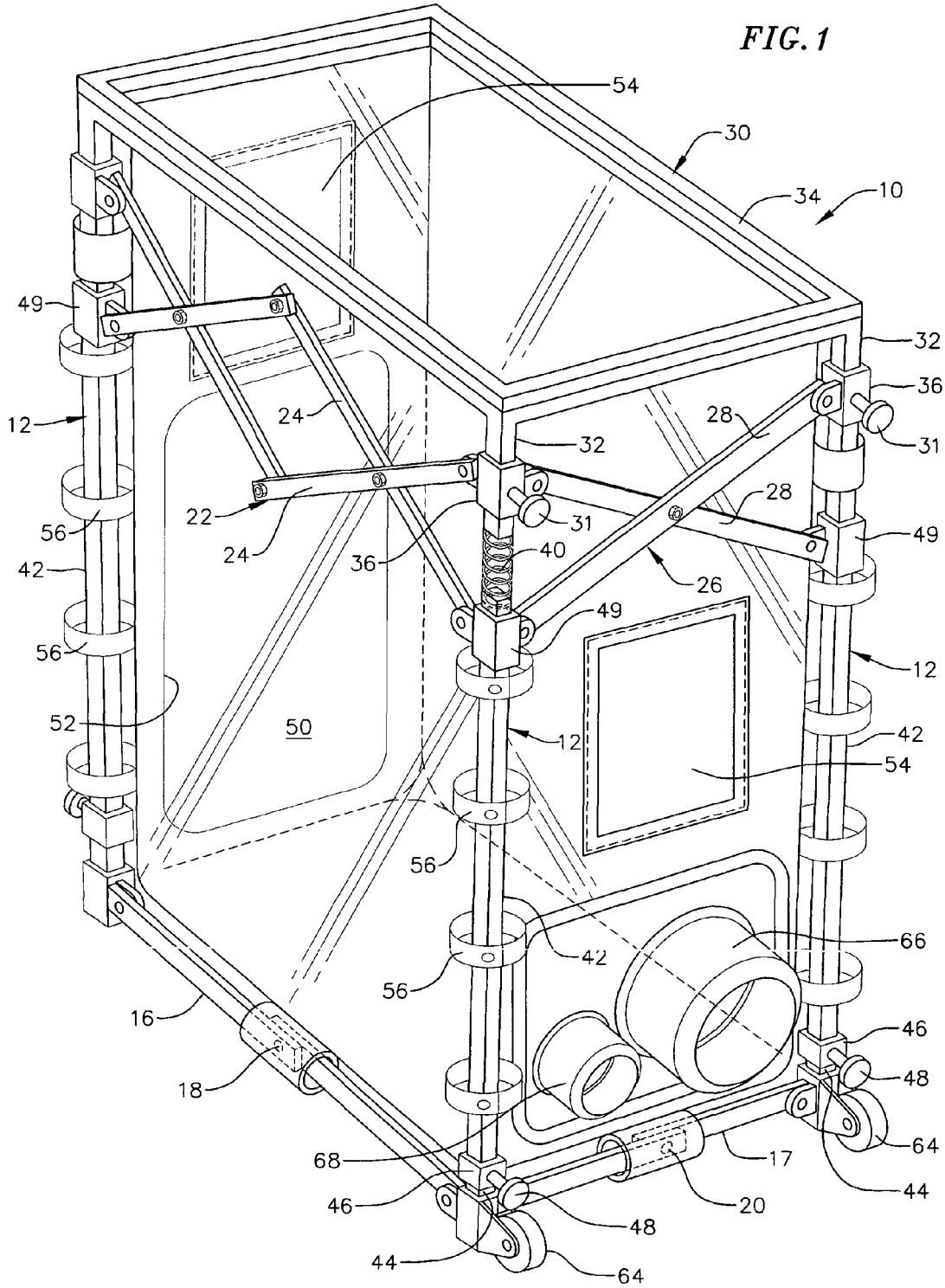
FIG. 1 is a perspective view of a fully opened enclosure according to the present invention prior to vertical extension and movement into an operating position.

The present invention comprises a rectangular enclosure 10 which comprises a plurality of hollow vertical frame members 12 and a first pair of horizontal frame members 16 located at the bottom of the enclosure extending along the front and rear lengthwise dimension of the enclosure. A second pair of horizontal frame members 17 join adjacent members 12 along the left and right widthwise dimension of the enclosure.

In the middle of the horizontal frame members 16, a hinge 18 is provided which is actuated vertically in an upward direction when the enclosure is collapsed into its folded position. A similar pair of hinges 20 are provided in the frame members 17 and these likewise pivot upwardly when the enclosure is collapsed. Adjacent vertical frame members in the lengthwise dimension are joined by a truss 22 on the front and rear of the enclosure which comprises a series of hinged articulated arms 24 extending between the vertical frame members 12. A set of second trusses 26 each comprising cross arms 28 join adjacent vertical members 12 along the left and right widthwise dimension of the enclosure. The lower arm of each truss is connected to a movable slider 49 which slides up and down vertical member 12 as the enclosure is opened and collapsed. When the unit is collapsed into its folded and closed position, trusses 22 and trusses 26 close in an accordion action to permit the vertical frame members 12 to be moved toward each other until they are closely spaced in the closed position.

A removable rectangular upper frame extension 30 having downwardly extending legs 32 is positioned above the vertical frame members and the legs 32 are telescopically received within the vertical frame members 12. The top of the upper frame member 30 engages the ceiling when the enclosure is in its raised and fully deployed position to permit the removal of one or more ceiling tiles directly above the enclosure and within the perimeter of the enclosure prior to work being done in the ceiling cavity. A nonporous foam bumper 34 extends around the periphery of upper frame member 30 to closely engage the ceiling and adopted to be pressed by spring compression against the ceiling to achieve a tight seal against the ceiling while the enclosure is used for work operations in the area above the ceiling. Outer leg caps 36 are provided at the top of the frame members 12 for receiving the downwardly extending legs 32 of the upper frame member 30. Set screws 31 are provided in the outer leg caps for tightening the leg caps against the legs 32 of the frame member to hold and lock the frame member 30 in a desired positions.

In FIG. 1 one of the vertical frame members 12 is shown with a portion broken away so as to illustrate a compression spring 40 located in the hollow interior of the frame member and seated within the vertical frame member 12 supporting the bottom of leg member 32 of the upper frame member 30. Similar compression springs are provided in each of the other three vertical frame members of the enclosure to provide spring compression for pressing the foam bumper 34 of the upper frame member to seal against the ceiling when the enclosure is fully extended vertically and abuts the ceiling in readiness for use.

Legs 32 are telescopically received within outer leg caps 36 and seat on top of compression springs 40. Compression springs 40 in turn are supported by sliders 49 which are mounted on top of frame members 12. Frame members 12 comprise an outer leg 42 and an inner leg 46. As shown in FIG. 1, the enclosure is in its retracted position in the sense that the upper frame member is at its lowest elevation and the hollow outer legs 42 receive vertically extending inner legs 44. A collar 46 is located at the bottom of outer legs 42 and provides a mounting for a pull pen or a set screw 48. When it is desired to raise the enclosure to the ceiling, an operator grasps the outer legs and raises the outer legs to the desired height. When the desired height is achieved, set screws 48 are extended inward and engaged with the inner legs 44 to lock the assembly in position. By exerting upward force on legs 42, bumper 34 engages and bears against the ceiling with springs 40 being compressed to make a releasable seal against the ceiling.

The closed interior of the enclosure is provided by a containment envelope 50 fabricated of a impermeable material such as vinyl or plastic sheeting. Provided at one side of the enclosure and incorporated into the envelope is a zippered entrance 52 which is used by a worker to enter and leave the enclosure. After a worker enters the enclosure the entrance covering is zipped closed to provide a totally enclosed compartment within the enclosure. Two windows 54 are provided on either side of the envelope to permit light to enter the enclosure and to permit the occupant inside the enclosure to see the exterior and to permit others on the outside of the enclosure to observe the occupant on the interior.

The envelope 50, in one exemplary embodiment, is supported by a plurality of cuffs 56 which encircle the vertical frame members 12 and which are secured to the envelope at spaced intervals by clips, Velcro connectors, snaps and the like. The envelope extends around the entire enclosure and across the entire bottom of the enclosure. It is secured to the top of the upper frame by Velcro or snap fasteners. When the upper frame is raised, the cuffs slide up the outer legs extending the envelope so that the closed environment of the enclosure is maintained.

Figure 8:
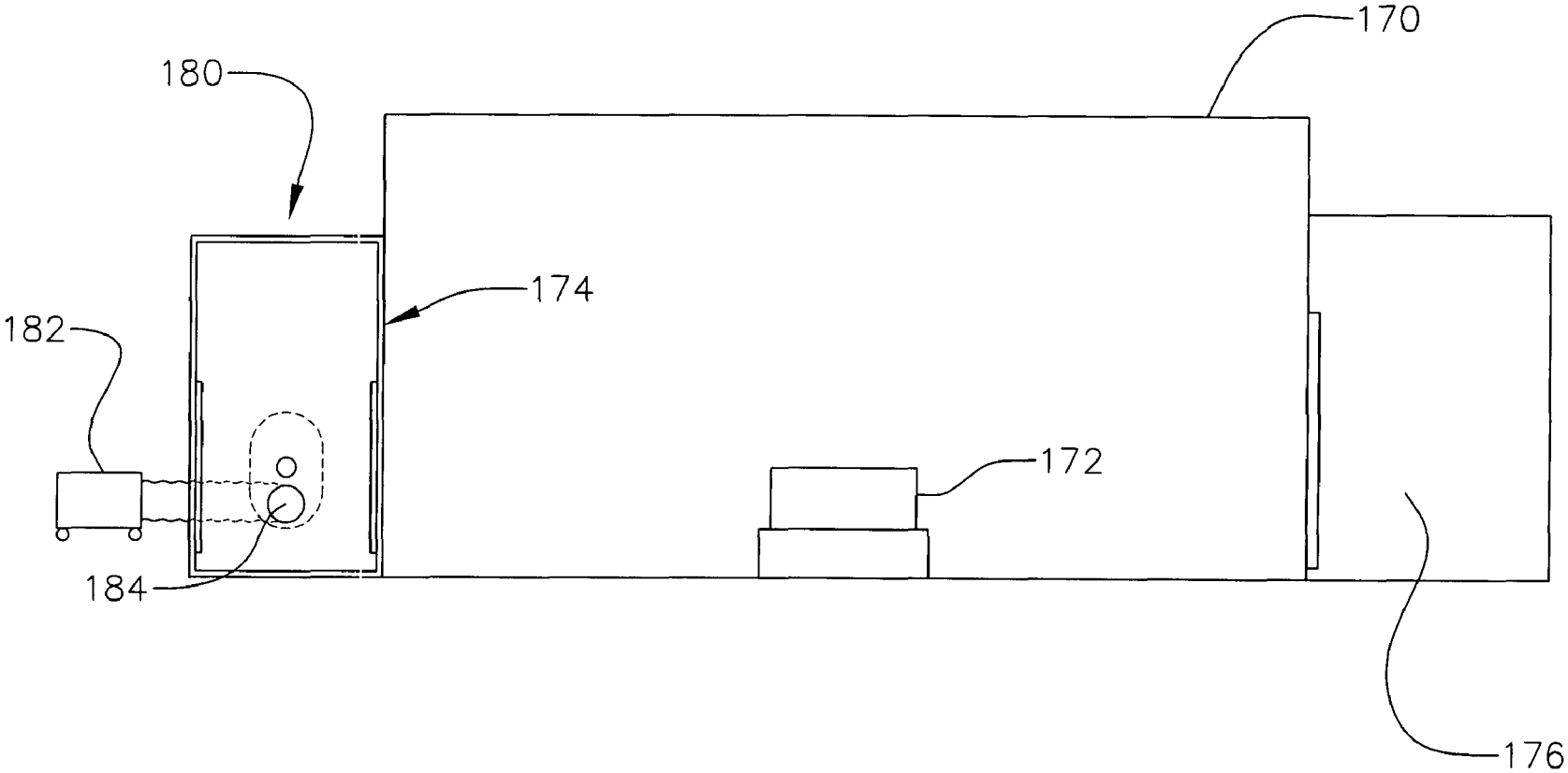
FIG. 8 is a diagram illustrating placement of the enclosure of the present invention outside a patient room to isolate the space within the room from the surrounding environment.

Shown at one side of the enclosure is a first duct 66 to which a HEPA vacuum is connected so that any contaminants, pathogens and the like which enter the enclosure are drawn out through duct 66 into a filtering apparatus 70 (see FIG. 8). A second duct 68 is shown adjacent to duct 66 to which is connected a vacuum pump for creating a negative pressure within the enclosure to cause any contaminants to be drawn downwardly and into the filter apparatus.

Figure 2:
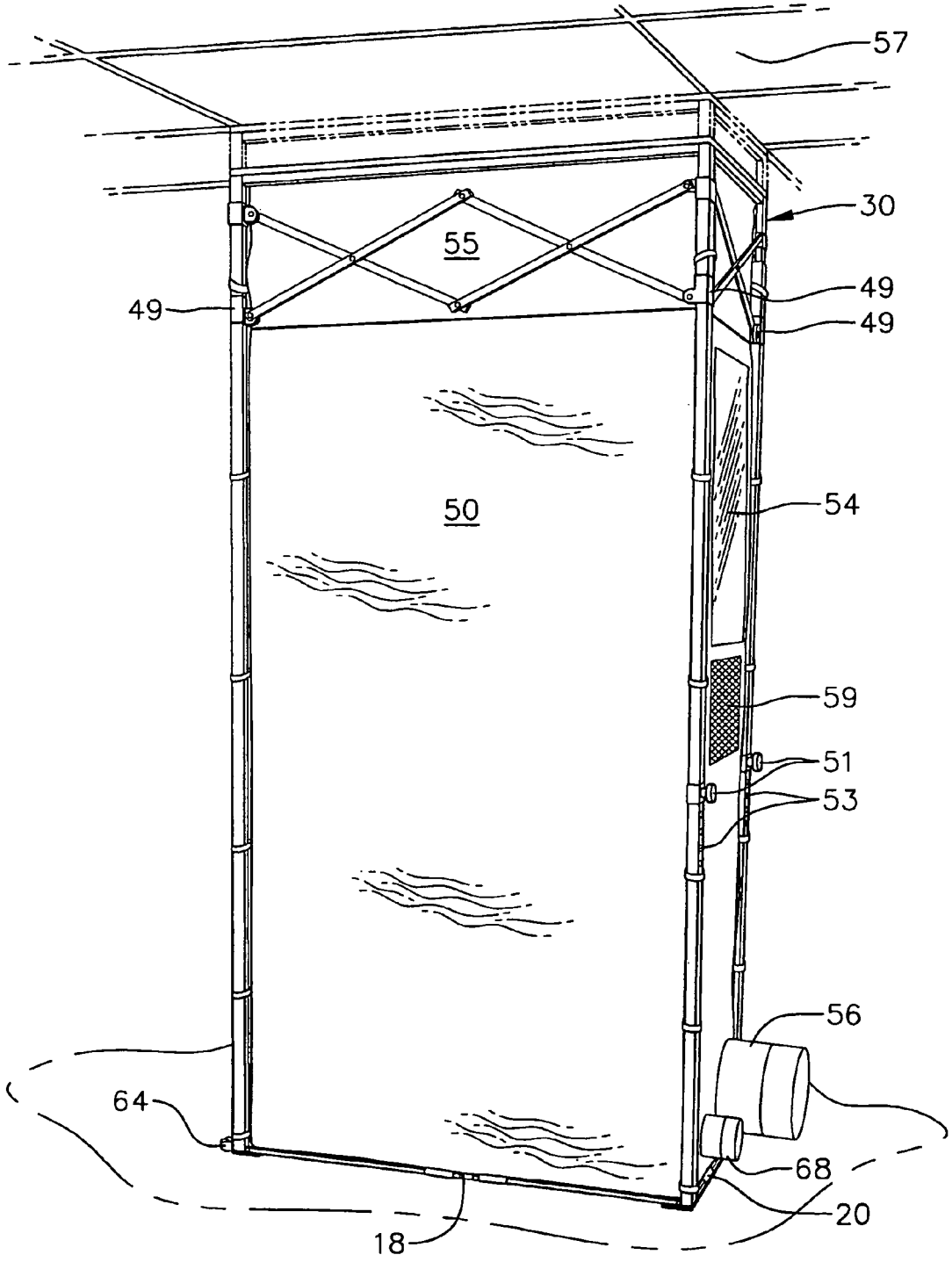
FIG. 2 is a perspective view of the enclosure according to the present invention after full vertical extension with the top of the enclosure abutting the ceiling.

The enclosure 10 is shown in its fully extended configuration in FIG. 2. Upper legs 42 are raised to the desired height and held in position on lower legs 44 by means of set screws. Alternatively pins 51 such as spring loaded pins can be used and inserted into apertures 53 to hold the upper portion of the enclosure at the desired height. Sliders 49 are locked into position at the top of frame members by spring loaded pins (not shown). The upper portion of the envelops 55 is connected around the interior of frame 30. Frame 30 is then raised to engage the ceiling 57 as shown in phantom in FIG. 2. The frame 30 is spring-loaded and held in position by set screws 31 or alternatively pins and aperture. Window 54 is shown in FIG. 2 as is a pocket 59 for storing instructions, specifications and other information pertinent to the work to be performed while using the enclosure.

The specific configuration of the containment envelope is related to the application for which the enclosure is used. The configuration can be tailored for wall access projects, ceiling cavity projects, as an anteroom for construction areas and for use in converting conventional patient rooms into isolation rooms.

When it is desired to move the enclosure or to store it, the set screws are loosened, the upper frame is lowered into the position shown in FIG. 1, and the envelope is allowed to drop and settle toward the bottom of the enclosure. The upper frame member 30 is then removed from the top of the enclosure. Hinges 18 and 20 are caused to pivot upwardly to bring the sides of the enclosure toward each other. At the same time, trusses 22 compress, sliders 49 move downwardly along frame members 12, and the arms of the truss approach a near vertical position in the totally collapsed condition. Similarly, the truss arms 28 of truss 26 scissor together to near vertical position. Provided at one side of the enclosure are a pair of wheels 64 which allow the unit to be tilted when it is folded so that it can be rolled to another position or rolled into a storage location. The upper frame member 30 is hinged at the corners to permit closing into a compact elongated configuration.

Figure 3:
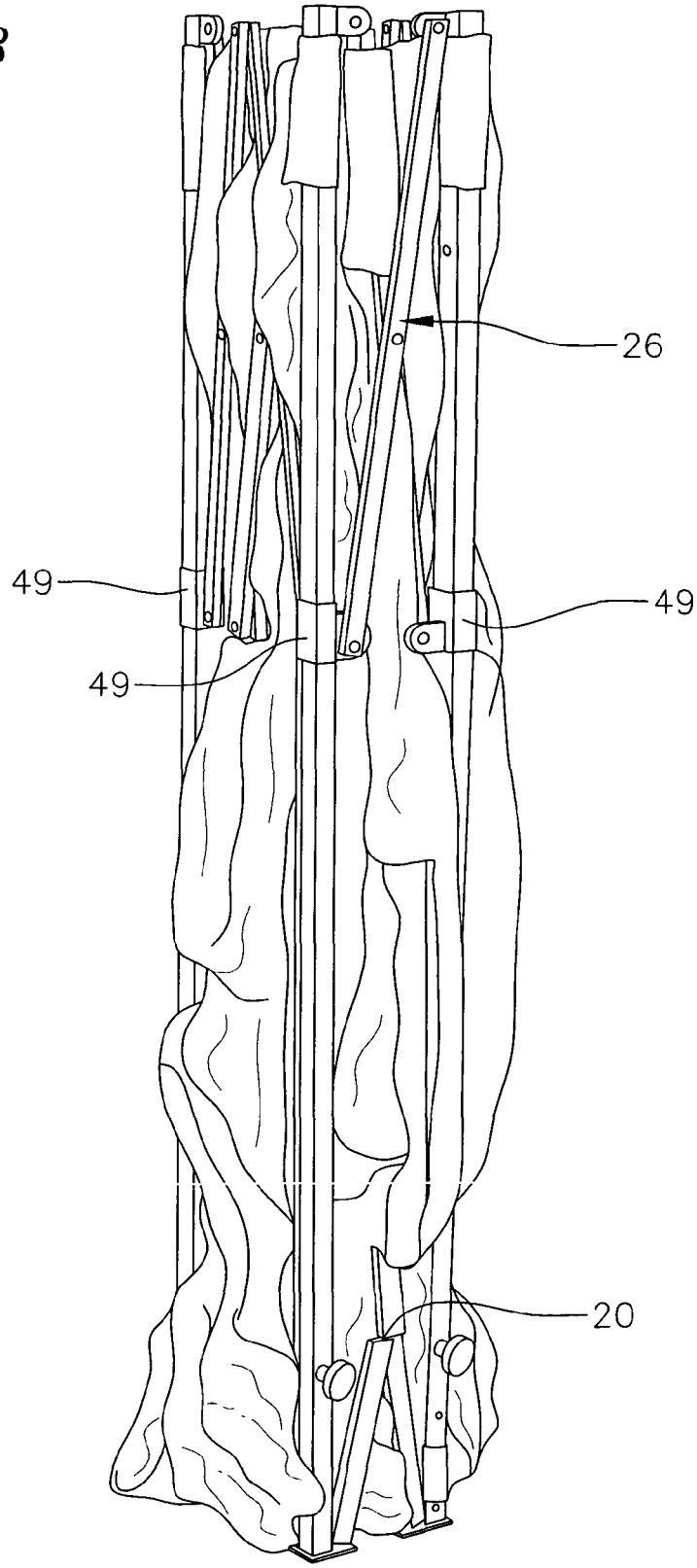
FIG. 3 is a perspective view of the enclosure of the present invention in a fully collapsed configuration before placement in a storage container.
Figure 4:
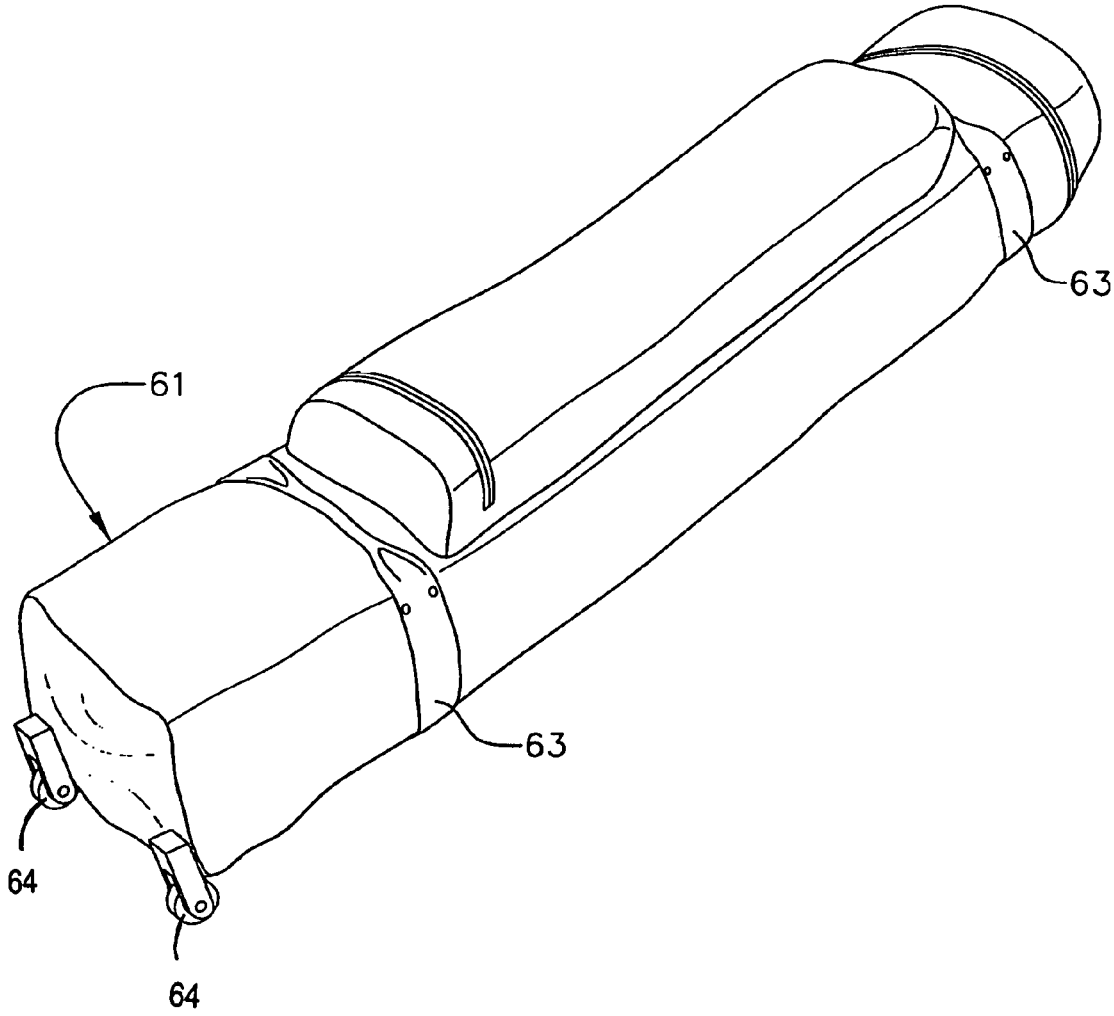
FIG. 4 is a perspective view of the enclosure of the present invention in its fully collapsed and folded condition in a storage container for ready portability.

After collapsing the enclosure into the configuration shown in FIG. 3, the apparatus is enclosed by drawing a fitted cover 61 over the top of the apparatus and then downwardly to the bottom of the apparatus. One or more belts 63 are provided to cinch the covering around the apparatus and hold the apparatus in a compact package. Wheels 64 at the bottom of the apparatus permit the apparatus to be rolled to a new location enhancing the portability of the apparatus.

Figure 5C:
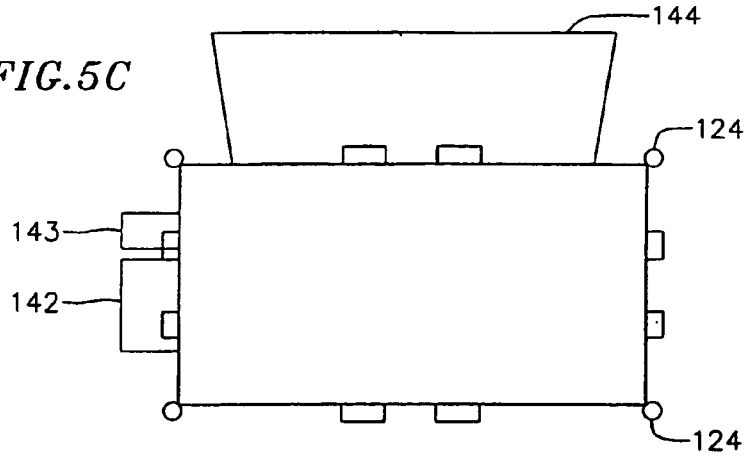
FIG. 5C is a top schematic view of the enclosure illustrating a flange enhancement extending from the rear of the enclosure.
Figure 5B:
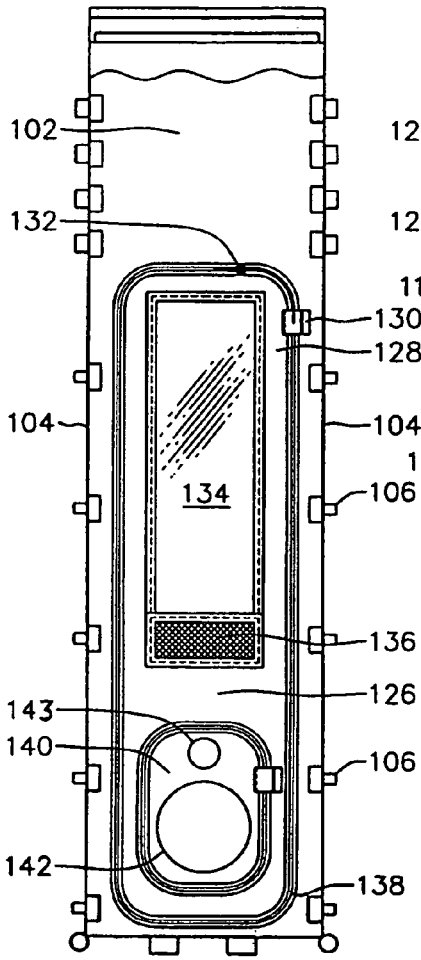
FIG. 5B is a side elevation schematic view of the embodiment of FIG. 5A taken from the left side of the enclosure.
Figure 5A:
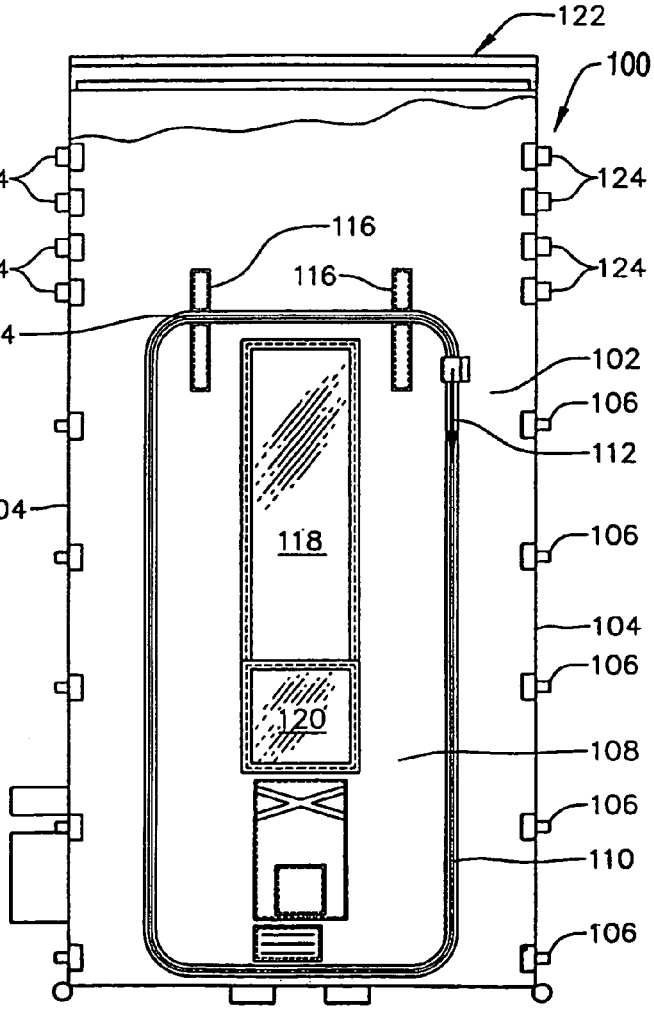
FIG. 5A is a front elevation schematic view of an alternate embodiment of the enclosure for providing access from all four sides of the enclosure.

Another embodiment of the environmental control unit of the present invention is illustrated FIGS. 5A, 5B and 5C. As shown in FIG. 5A, the enclosure comprises the enclosure 10, a four-sided flexible envelope 102 mounted on vertical supports 104 by means of a series of snap cuffs 106 which are attached to the outer periphery of the envelope and are also attached to the vertical supports. FIG. 5A illustrates the primary entry side of the enclosure. As shown therein it includes a door panel 108 which is secured in place by means of a zipper 110. The direction of travel of the zipper is shown by arrow 112. The zipper extends around the entire periphery of the panel to permit removal of the door panel. Likewise, the zipper can be stopped at stop 114 and if desired it can be rolled up and retained by Velcro straps 116 to provide full access to the interior of the envelope.

The door panel has a clear vinyl window 118 provided in the center thereof and below it is a pouch 120. An upper portion 122 of the enclosure is height adjustable along the vertical supports which gives the basic four sided outline to the enclosure. The envelope is secured by a plurality of cuffs 124 which are closely spaced as shown in FIG. 5A. When it is desired to adjust the height of the enclosure, the upper portion 122 is extended upwardly and the cuffs are slidably moved on the vertical supports to allow the upper portion to be extended until it reaches the desired height, typically coming into contact with a ceiling or ceiling tiles.

The door panel 108 is of a flexible material as is the rest of the enclosure to permit it to be rolled up when unzipped and to also permit it to be collapsed with the rest of the enclosure when the enclosure is collapsed down into a size for easy portability.

In FIG. 5B, the left side of the enclosure shown in FIG. 5A, is illustrated. As shown therein it comprises a flexible side wall 126 and contained within it is a panel 128 secured in the side wall by means of a zipper 130. The direction of travel 132 of the zipper is shown and similar to door panel 108, the side panel 128 is "zip out" in configuration and can be either removed or flipped open when the zipper is traversed around at least three sides of the side panel. A vinyl window 134 is provided in the side panel and at the base of the vinyl window is a negative air vent 136. The panel 128 can be used to function as a door by stopping the zipper at stop 138 to create a door opening.

Below the window is located a zip-out panel 140 which includes ducts 142, 143 to which are connected pumps and other evacuating equipment which are utilized to maintain a predetermined air pressure within the enclosure and to withdraw any contaminants which enter the enclosure and communicate such contaminants into a closed container connected to a pump to prevent escape of any contaminants to the atmosphere outside of the enclosure.

Referring now to FIG. 5C, a view taken from the top of the enclosure, the rectangular outline of the enclosure is clearly illustrated as are representative slidable cuffs 124. Ducts 142, 143 appear at the side. Extending from the rear is a flange 144 which is slightly flared outwardly from the enclosure and is rectangular in elevation and is secured to the rear side of the enclosure 10 as will be more fully disclosed in conjunction with the discussion of FIGS. 6A and 6B. The flange is secured in an air-tight manner to the rear side of enclosure 100 and extends outwardly. The flange 144 is of the same flexible material as the envelope 102 and can be securely attached around a door frame so as to seal the entire periphery of the door frame and thereby seal off the room inside from the atmosphere on the outside of the envelope. When the flange is secured around the door frame to a room such as a patient's room, the functionality of the enclosure is as an anteroom sealed to the entry into the room to provide a mechanism for isolating the room to which the enclosure is attached.

This is particularly important and useful in hospitals and healthcare environments when a serious risk of air borne infection is present and the patient and the room in which the patient is located needs to be isolated from the rest of the environment outside the patient's room. In a typical configuration, the rectangular flange 144 is three to four feet wide, six to seven feet and twelve to twenty inches deep high so as to easily fit around the entire periphery of a typical doorway.

Figure 6B:
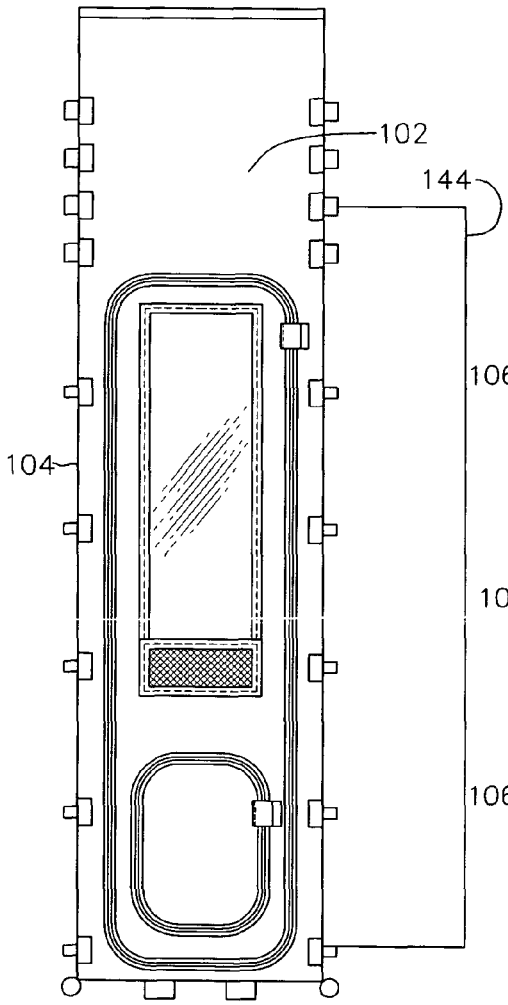
FIG. 6B is a side schematic view of the enclosure taken from the side opposite FIG. 5B.
Figure 6A:
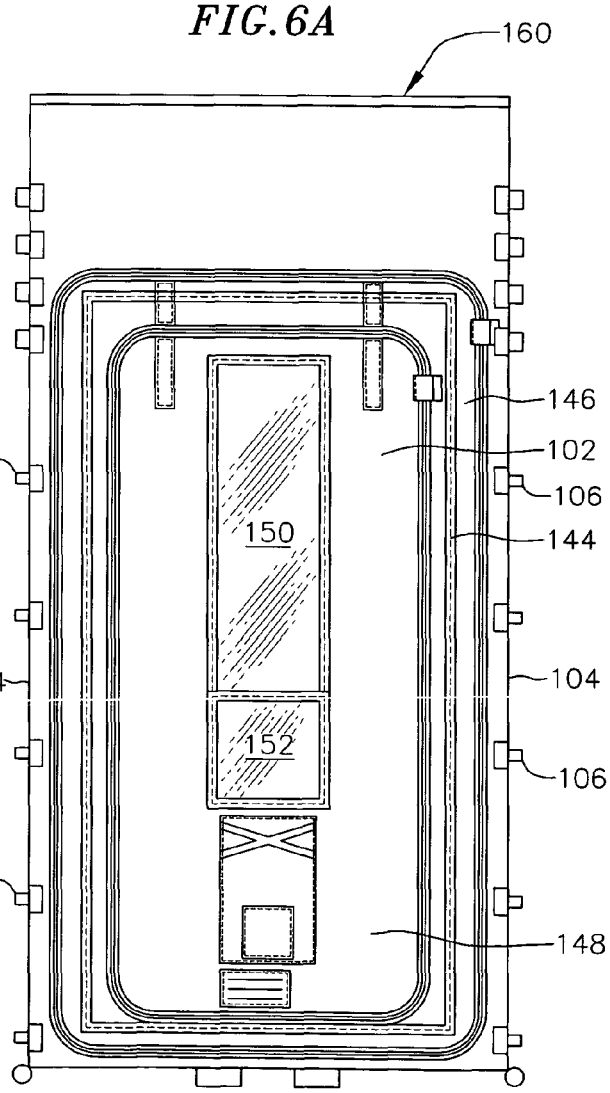
FIG. 6A is a rear schematic elevation view of the enclosure shown in the preceding 5A to 5C figures illustrating the positioning and rectangular configuration of the flange.

These aspects of the enclosure will be further understood by reference to FIGS. 6A and 6B in which FIG. 6A is an elevation view of the wide side of the enclosure opposite the side shown in FIG. 5A. As shown therein, this side of the enclosure has two zippered panels. The first being panel 146 which is slightly larger than the periphery of flange 144 and is secured around it periphery by a zipper 148. Extending the zipper around the entire periphery of panel 146 permits its removal together with the flange 144 and an inner zip-out panel 148. Second zip-out panel 148 is located interiorly of the periphery of the flange 144 and includes a clear flexible vinyl window 150 and below it a pouch 152 into which information, messages, charts, other materials related to the use of the enclosure can be placed. The two zipper arrangement provides complete flexibility allowing panel 148 to be removed when the flange is in place and sealed to the periphery of a door way to a room permitting the use of the enclosure as a means of maintaining isolation of the room which still permits entry and exit of medical personnel, etc. A person desiring entry into the room to which the enclosure is attached would first unzip panel 108 on the front and then reinstall it to completely close the interior of the environmental control enclosure. Once that has been established and the negative atmosphere created and sterilized, door panel 148 is approached and the party desiring entry into the room, for example to treat a patient, unzips panel 148 and enters the patient's room. The steps in reverse are followed when a party leaves the patient's room.

Figure 7:
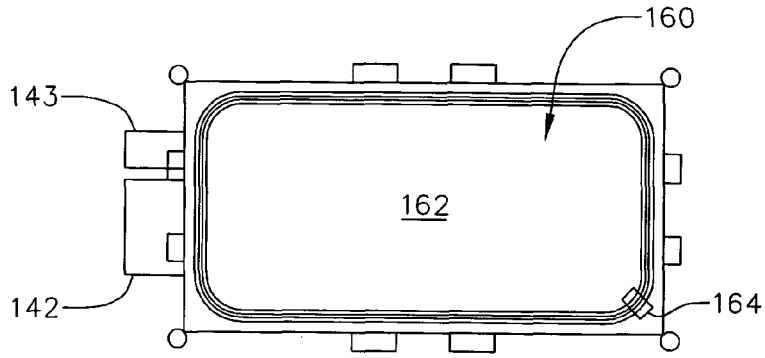
FIG. 7 is a schematic view of the top of the enclosure illustrating a removable section to provide an opening when the enclosure is raised against a ceiling.

Referring now to FIG. 7, a top view of another embodiment of an enclosure according to the present invention. As shown therein, the top 160 includes a removable zippered panel 162. A zipper 164 is utilized to attach and detach the panel from the top 160. This structure enables the envelope to function when the user is working in ceiling cavities. The top portion of the enclosure is height adjustable in a range from approximately 7 feet to approximately 11 feet in height. In use it is brought into position and the top portion extended to contact and be sealed against the ceiling. Panel 162 is zipped out and the user has access to the ceiling tiles and the ceiling cavity beyond.

The enclosure of the present invention has multiple applications. It can be used to provide an anteroom for construction and maintenance projects in walls and ceilings in patient occupied areas. It is engineered to provide a negative pressure entry and exit chamber. Doors can be provided in all four sides for greater flexibility. Negative air ports can be switched from one side to the other. A flange can be attached around a door frame and when sealed prevents contaminants from escaping the enclosure. When used to isolate a patient's room, the enclosure provides a convenient, quick, safe conversion of patient room into an isolation room by creating an anteroom "airlock" between the room and the outside corridor into which the room opens.

The diagram of FIG. 8 illustrates the use of the enclosure according to the present invention as a mechanism for providing isolation of a room such as a patient's room in a hospital. The present invention enables rapid conversion of a room into an isolation room.

As shown therein, a conventional patient room 170 is furnished with a bed 172 and typically has a doorway 174 for entry into the room and a bathroom 176 which is connected to room 170 by a second doorway 178.

To isolate patient room 170, an enclosure 180 according to the present invention is placed adjacent doorway 174. The embodiment of the invention shown in FIGS. 5 and 6 is utilized with the flange attached around the periphery of the doorway and sealed to the periphery to prevent airborne particulates from escaping from the enclosure 180. In effect, the enclosed provides an "airlock" between the room 170 and the corridor outside. A HEPA filtered negative air machine 182 is connected to duct 184 to complete the conversion and isolation. Typically the machine provides negative air pressure of a minimum of 300 CFM prescribed by the requirements of the Centers for Disease Control and Prevention. The result is an important tool, particularly useful in dealing with emergency situations requiring quick conversion of a conventional room to an isolated room to prevent the spread of infection to other areas of the health-care facility.

What is claimed is:

1. A portable collapsible environmental containment unit comprising:

(a) a collapsible, unitary framework having a set of extendable vertical supports;

(b) at least one collapsible unitary horizontal support element extending between adjacent vertical supports, and (c) a flexible collapsible containment envelope secured to the interior of the framework and extending from the top of the containment unit downward to enclose the sides and bottom of the containment unit wherein the vertical supports can be raised to ceiling level and held in position against the ceiling to create a controlled environment within the containment unit and wherein the extendable vertical supports comprise first and second set of vertical supports, the second set being telescopically received in the first set and further including a unitary frame extension and flexible envelope removably mounted at the top of the framework and adapted to telescopically engage the top of the vertical supports wherein the containment envelope is open at the top to facilitate working in ceiling cavities and further including a removable opening on at least one vertical side of the containment envelope to permit ingress and egress of a worker when the enclosure is placed in working relation with a ceiling cavity.

2. A containment unit according to claim 1 including a panel of two ducts, each extending through the containment envelope from the interior to the exterior of the containment envelope.

3. A containment unit according to claim 2 having a negative air machine connected to one of the ducts for creating negative air pressure within the containment envelope.

4. A containment unit according to claim 3 including a filter apparatus connected to one of said ducts for collecting airborne particulates drawn into the containment envelope.

5. A containment unit according to claim 4 wherein a pair of wheels are attached at the base of the framework to facilitate moving the apparatus in the collapsed or extended condition.

6. A portable collapsible environmental containment unit comprising:

a collapsible unitary framework including extendable and retractable vertical supports, collapsible unitary horizontal supports interconnecting pairs of vertical supports, a closed flexible impermeable envelope secured to the framework on the interior thereof, the framework and envelope when in the fully erected condition defining a working enclosure of sufficient interior size to permit a fully erect worker to function; and a four sided flange extension attached to a side of the envelope adapted to be sealably attached around a door opening to isolate the environment of a space located interiorly of the door opening wherein the framework and envelope form a portable self-contained package when collapsed.

7. A containment unit according to claim 6 having at least one closable-access panel in the envelope to permit access to and from the enclosure.

8. A containment unit according to claim 7 having at least one transparent section in the side of the envelope to permit viewing into and out of the enclosure.

9. A containment unit according to claim 8 having at least one port in the side of the envelope for the attachment of air pressure reducing equipment.

10. A containment unit according to claim 7 wherein the access panel is in the side of envelope opposite the four-sided extension.

11. A containment unit according to claim 7 wherein a second closable access panel is provided in the side of the envelope in which the flange is located.

12. A containment unit according to claim 7 wherein a closable panel is provided in the top of the envelope.

13. A containment unit according to claim 9 wherein the port is mounted in a removable panel.

14. A portable collapsible environmental containment unit comprising:

a collapsible unitary framework comprising:

a plurality of vertical supports, a first collapsible horizontal support extending between a first adjacent pair of the vertical supports along the lengthwise dimension of the containment unit, and a second collapsible horizontal support extending between a second adjacent pair of the vertical supports along the widthwise dimension of the containment unit;

a closed flexible impermeable containment envelope secured to the framework on the interior thereof, the framework and containment envelope when in the fully erected condition defining a working enclosure of sufficient interior size to permit a fully erect worker to function therein;

a four sided extension attached to a side of the containment envelope adapted to be sealably attached around a door opening to isolate the environment of a room within; and a first separable and resealable portion disposed in said side of the containment envelope to which the four sided extension is attached, wherein the first separable portion forms a first entrance/exit to the containment envelope to permit access to and from the enclosure through each of said door opening and said four sided extension.

15. A containment unit according to claim 14 comprising a second separable portion in the containment envelope that forms a second entrance/exit to the containment envelope to permit access to and from the containment envelope.

16. A containment unit according to claim 14 comprising at least one transparent section defining a portion of a side of the containment envelope to permit viewing into and out of the containment envelope.

17. A containment unit according to claim 14 having a first port in a side of the containment envelope for the attachment of air pressure reducing equipment.

18. A containment unit according to claim 17 having a second port in a side of the containment envelope for the attachment of a filter apparatus for collecting air borne particulates.

19. A containment unit according to claim 15 wherein the second entrance/exit is disposed in a side of the containment envelope that does not contain the four-sided extension.

20. A containment unit according to claim 15 wherein the second entrance/exit is disposed in a side of the containment envelope opposite from the four-sided extension.

21. A containment unit according to claim 15 wherein the second entrance/exit is disposed in the top of the containment envelope.

22. A containment unit according to claim 14 comprising at least one removable panel.

23. A containment unit according to claim 14 wherein the first separable portion forms a first access panel that is removably attached to the containment envelope.

24. A containment unit according to claim 15 wherein the second separable portion is resealable.

25. A containment unit according to claim 15 wherein the second separable portion forms a second access panel that is removably attached to the containment envelope.

26. A containment unit according to claim 22 comprising a first port in a side of the containment envelope for the attachment of air pressure reducing equipment and a second port in a side of the containment envelope for the attachment of a filter apparatus for collecting air borne particulates, wherein the first and second ports are each disposed in one of the at least one removable panels.

27. A containment unit according to claim 14 wherein the four sided extension is removably attached to said side of the containment envelope.

28. A containment unit according to claim 14 wherein the four sided extension is flared outwardly from its attachment to said side of the containment envelope.

29. A containment unit according to claim 14 wherein the first collapsible horizontal support comprise at least one truss.

30. A containment unit according to claim 29 wherein the second collapsible support comprise at least one truss.

31. A portable collapsible environmental containment unit comprising:

a collapsible unitary framework comprising extendable and retractable vertical and horizontal supports, a closed flexible impermeable containment envelope secured to the framework on the interior thereof, the framework and containment envelope when in the fully erected condition defining a working enclosure of sufficient interior size to permit a fully erect worker to function therein;

a four-sided, flange extension attached to one side of the containment envelope adapted to be sealably attached around a door opening to isolate the environment of a room within; and a first separable and closable portion disposed in said side of the containment envelope to which the four-sided extension is attached, wherein the first closable portion forms a first entrance/exit to the containment envelope to permit access to and from the enclosure through each of said door opening and said four sided extension.

32. A containment unit according to claim 31 comprising a second separable portion in the containment envelope that forms a second entrance/exit to the containment envelope to permit access to and from the containment envelope.

33. A containment unit according to claim 31 comprising at least one transparent section defining a portion of a side of the containment envelope to permit viewing into and out of the containment envelope.

34. A containment unit according to claim 31 having at least one removable duct panel in a side of the containment envelope for the attachment of air pressure reducing equipment.

35. A containment unit according to claim 32 wherein the second entrance/exit is disposed in a side of the containment envelope that does not contain the four-sided extension.

36. A containment unit according to claim 32 wherein the second entrance/exit is disposed in a side of the envelope opposite from the four-sided extension.

37. A containment unit according to claim 32 wherein the second entrance/exit is disposed in a side of the containment envelope adjacent the four-sided extension.

38. A containment unit according to claim 31 comprising at least one removable panel.

39. A containment unit according to claim 31 wherein the first separable portion forms a first access panel that is removably attached to the containment envelope.

40. A containment unit according to claim 32 wherein the second separable portion is resealable.

41. A containment unit according to claim 40 wherein the second separable portion forms a second access panel that is removably attached to the containment envelope.

42. A containment unit according to claim 38 comprising a first port in a side of the containment envelope for the attachment of air pressure reducing equipment, wherein the first port is disposed in one of the at least one removable panels.

43. A containment unit according to claim 42 comprising a second port in a side of the containment envelope for the attachment of a filter apparatus for collecting air borne particulates, wherein the second port is disposed in one of the at least one removable panels.

44. A containment unit according to claim 31 wherein the four sided extension is removably attached to said side of the containment envelope.

45. A containment unit according to claim 31 wherein the four sided extension is flared outwardly from its attachment to said side of the containment envelope.

46. A containment unit according to claim 31 wherein the collapsible framework encloses collapsible horizontal supports extending between adjacent ones of the plurality of vertical supports.

47. A containment unit according to claim 46 wherein the horizontal supports comprise at least one truss.

48. A containment unit according to claim 31 further comprising first collapsible supports extending between a first adjacent pair of the vertical supports along the lengthwise dimension of the containment unit.

49. A containment unit according to claim 48 further comprising second collapsible supports extending between a second adjacent pair of the vertical supports along the widthwise dimension of the containment unit.

50. A containment unit according to claim 49 further comprising a plurality of sliders mounted on each vertical support and connected to a bottom portion of each of the first and second collapsible supports.

51. A containment unit according to claim 49 wherein the first collapsible supports comprise at least one truss.

52. A containment unit according to claim 51 wherein the second collapsible supports comprise at least one truss.

53. A portable collapsible environmental unit comprising:

a unitary collapsible framework including extendable and retractable vertical and horizontal supports, a closed flexible impermeable envelope secured to the framework interiorly thereof, the framework and envelope when in the fully erected condition defining a working enclosure of sufficient interior size to permit a fully erect worker to function therein; and an auxiliary extendable and retractable framework and envelope assembly mounted on top of the vertical supports for vertical extension into sealing engagement around an opening in a ceiling for isolating the environment above the ceiling from the space where the containment unit is deployed.

* * * * *